United States Patent [19]

Hardin

[11] Patent Number: 4,858,360

[45] Date of Patent: Aug. 22, 1989

[54] RAM-ROD CLEANING ROD DEVICE FOR BLACK POWDER FIREARMS

[76] Inventor: Grant W. Hardin, Rt. 2, Box 960, Elizabethton, Tenn. 37643

[21] Appl. No.: 237,749

[22] Filed: Aug. 29, 1988

[51] Int. Cl.[4] ..... F41C 31/00

[52] U.S. Cl. ..... 42/95; 15/104.20

[58] Field of Search ..... 42/95, 96; 15/104.16, 15/104.65, 104.20

[56] References Cited

U.S. PATENT DOCUMENTS

| | | | |
|---|---|---|---|
| 268,004 | 11/1982 | Davis | 15/104.20 |
| 652,096 | 6/1900 | Dunn | 15/104.165 |
| 1,522,837 | 1/1925 | Rebar | 42/95 |
| 1,552,994 | 9/1925 | Lindeman | 42/95 |
| 1,591,425 | 7/1926 | Kingman | 15/104.16 |
| 1,899,269 | 2/1933 | Hakes | 15/104.16 |
| 2,232,358 | 2/1941 | Baerer | 15/104.20 |
| 2,367,900 | 1/1945 | Stine | 15/104.20 |
| 3,814,525 | 6/1974 | Spencer | 15/104.165 |
| 4,404,979 | 9/1983 | Hobbs | 42/95 |

FOREIGN PATENT DOCUMENTS

| | | | |
|---|---|---|---|
| 261412 | 1/1927 | United Kingdom | 42/95 |

*Primary Examiner*—Deborah L. Kyle
*Assistant Examiner*—Michael J. Carone
*Attorney, Agent, or Firm*—Taylor R. Laddie

[57] ABSTRACT

A ram-rod/cleaning rod device for the barrel of a black powder firearm comprises an essentially straight hollow rod having openings therein for allowing cleaning liquid to pass therethrough. Alternately, an equivalent hollow rod without openings in the walls therein, having means for dispersing a cleaning liquid into the barrel of the weapon being cleaned may be utilized. Advantageously, an efficient cleaning tip is provided at the end of the rod.

2 Claims, 3 Drawing Sheets

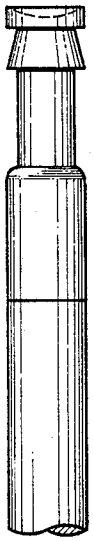
· Fig. 1 ·
PRIOR ART
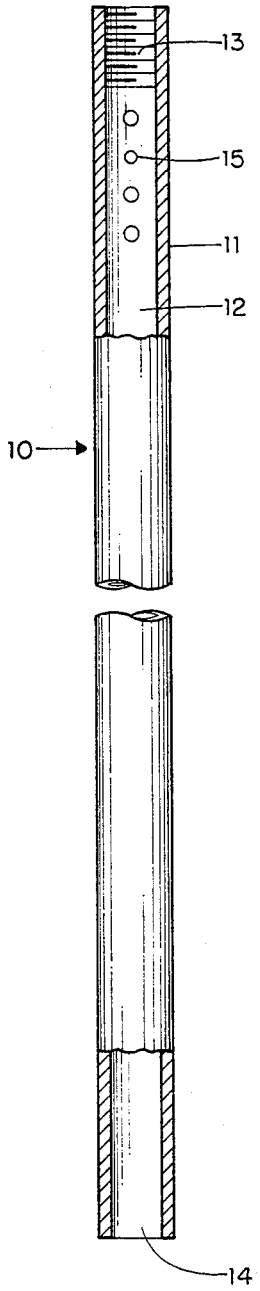
· Fig. 2 ·

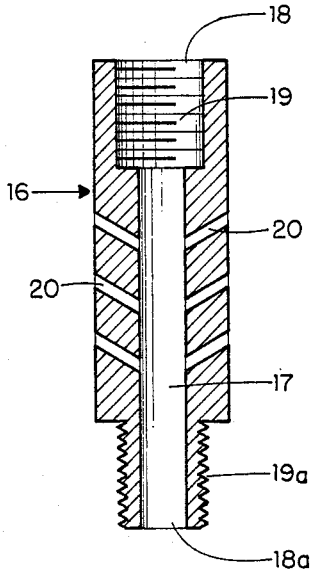
· Fig. 3 ·
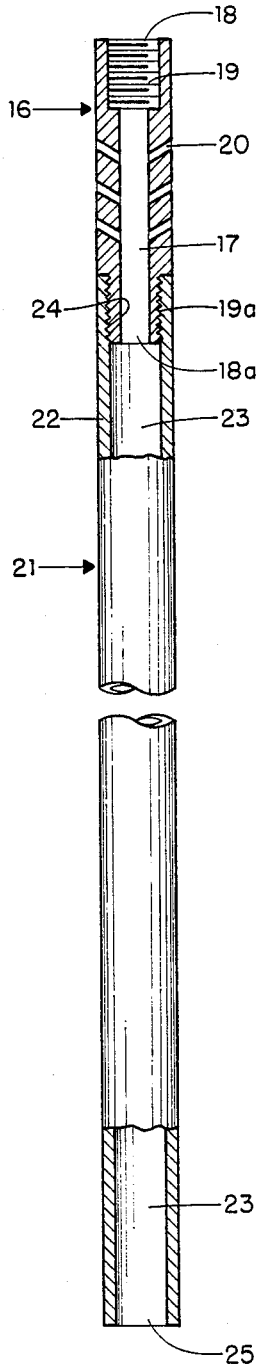
· Fig. 4 ·

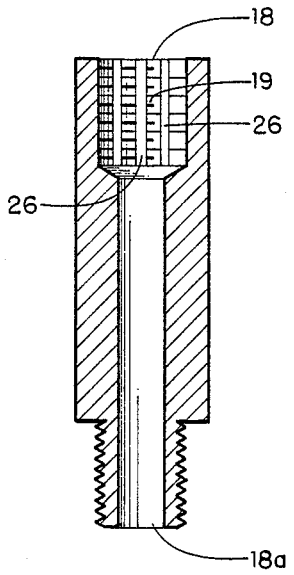
· Fig. 5 ·
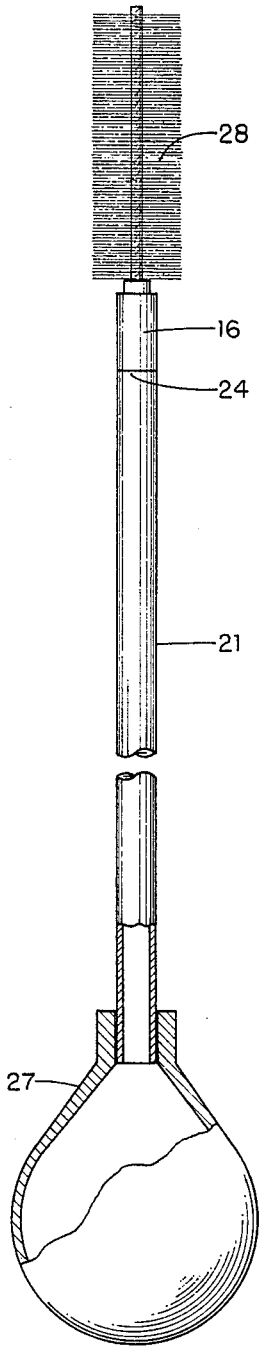
· Fig. 6 ·

RAM-ROD CLEANING ROD DEVICE FOR BLACK POWDER FIREARMS

DESCRIPTION

The present invention pertains to a unique device for use both as a typical ram-rod and a superior cleaning appliance for the barrels of firearms which utilize black powder for discharging ammunition, both flintlock or percussion firing types. The invention is applicable to both rifle and pistol black-powder weapons.

1. Background of the Invention

One of the exceedingly difficult problems association with the operation of black powder weapons has traditionally been the laborious dirty, time-consuming chore of adequately and properly cleaning the barrel of the weapon following use to remove the residue of the firing operation using known methods and equipment.

The nature of the black powder residue is such that cleaning the barrel of the firearm quickly and/or easily following firing is necessary if one does not wish to allow the barrel to corrode badly in a very short time.

2. Summary of the Invention

Basically, the present invention provides a ram-rod/-cleaning rod device for use in the barrel of a black powder firearm which can be employed, among other adaptations, as a swift, efficient apparatus for ridding the barrel of essentially all of the residue produced during the firing of the weapon. The device generally comprises a hollow rod particularly designed and adapted such that a liquid, especially a cleaning liquid, can efficiently be delivered into all areas of the barrel to produce a very clean surface therein. The outside diameter and length of the device, as well as the inside diameter thereof, is, of course, dictated by the dimensions of the specific barrel.

It is of utmost importance to maintain a clean barrel surface because of the corrosion properties of black powder residues, particularly the sulfur compounds, resulting from the combustion of the black powder.

Additionally, the buildup of residue produces rapid fouling of the barrel, which may result in sticking of the bullet and possible actual rupture of the barrel upon firing.

A tip or cleaning tip for a ram-rod for a black powder firearm is well known in the art and comprises a brass or other hard substance device usually concave at one end for accepting the bullet. The tip may be integral to the ram-rod, or, as in the case of one embodiment this invention, attachable directly to the end of the ram-rod. Although the design of the conventional tip usually comprises ridges or barbs on the surface thereof, as shown in FIG. 1, these are not shown in the definitive views herein for clarity in understanding of the device described, since they form no part of the invention as claimed. These ridges are generally for the purpose of "seating" a cleaning patch or the like during use, and may be present in the tip as claimed.

The general function of the conventional tip is to "seat" the bullet on the black powder charge in the barrel during the loading of the gun, to hold cleaning patches, or accept a fitting that will accept other gun-cleaning accessories.

Other terms in the art used to describe or define this tip are: ram-rod tip, bullet-ramming tip, or gun servicing holding fixture.

One unique feature of this device is that the threaded end of the rod of this invention can be utilized to mount a cleaning patch jag, lost patch retriever, fouling scraper or bullet puller, as well as, or in connection with, a cleaning tip or the like. The invention is thus truly a universal manipulatory tool for the barrel of a black powder weapon.

BRIEF DESCRIPTION OF THE DRAWINGS

The invention will become more apparent when described in conjunction with the drawings, in which like reference numerals designate like parts in the views, and wherein:

FIG. 1 is a broken side view of a known cleaning tip for use in cleaning the barrel of a black powder firearm (prior art).

FIG. 2 is a broken side view with broken-out sections of a ram-rod cleaning rod according to one aspect of the invention.

FIG. 3 is a broken side view with broken-out sections of a cleaning tip for use with a hollow ram-rod cleaning rod according to another aspect of the invention.

FIG. 4 is a broken side view with broken-out sections of a ram-rod cleaning rod device according to another aspect of the invention.

FIG. 5 is a longitudinal section of a preferred embodiment of the cleaning tip of the invention.

FIG. 6 is a broken side view with broken out sections of one configuration of the invention with accessories for use in cleaning the barrel of a black powder firearm.

DETAILED DESCRIPTION OF THE INVENTION

Referring to FIG. 2, one embodiment of the present invention comprises a ram-rod/cleaning rod device 10 for the barrel portion of a black powder firearm comprising an essentially straight hollow rod 11, the hollow portion labelled 12 in the drawing, of a length at least about equal to the length of the barrel portion of the firearm to be cleaned, the device having a threaded section 13 at one end of a length sufficient to secure an accessory component thereto having a like-mating threaded section. Although the threaded portion 13 is shown within the hollow portion 12 of the rod, the threads may alternately be located on the outside thereof in any embodiment of the invention. Means for receiving a liquid component through the hollow portion 12 of the rod are located at the opposite end 14 from the threaded end of the rod. This may consist only of the end 14 of the hollow rod. A plurality of openings 15 are provided about the wall of rod, extending from the hollow portion to the surface thereof, at a distance from the end of the threaded section sufficient to provide means for allowing a liquid component in the hollow portion of the rod to exit therefrom. Ideally, these openings 15 do not extend more than one-half the distance from the threaded end 13 of the rod to the opposite end thereof. The threaded end 13 of the rod may be capped to provide retention of cleaning liquid for a more positive pressure flow of the liquid through openings 15.

Preferably, a hollow cleaning tip 16, shown in FIG. 3, the hollow portion labelled 17 in the drawing, having two ends 18 and **18*a* with threaded sections 19 and 19*a* at each end of the hollow portion has one end threadedly engaged with the threaded portion 13 of the cleaning device 10**.

Although the cleaning tip 16 is shown with a female-type threaded portion at end 18 inside the hollow 17 and a male-type threaded portion at the outside end 18*a* of the tip 16, the threads may be alternately be located either both outside the ends of the hollow tip, inside the ends of the hollow tip, or opposite locations at the ends of the tip.

The cleaning tip 16 has a plurality of ports 20 (i.e., holes) therein originating at the hollow portion 17 of the tip and terminating at the tip's surface to allow passage of a liquid from the hollow portion 17 to flow to the outside to the surface of the tip. Although the ports 20 are shown through the wall of the tip 16 exiting at an angle, as is preferred, they may be effectively be positioned directly through the inside to outside surface of the hollow tip or at any other angle than illustrated.

Referring to FIG. 4, in the preferred embodiment of the invention, the ram-rod/cleaning rod device 21 comprises an essentially straight hollow rod 22, openings or the hollow portion labelled 23 in the drawing, of a length at least about equal to the length of the barrel portion to be cleaned, the device having a threaded section 24 at one end of a length sufficient to secure an accessory component having a mating threaded section, and means for receiving a liquid component through the hollow portion 23 of the rod at the opposite end 25 of the rod from the threaded portion. A hollow cleaning tip 16, the hollow portion labelled 17 in the drawing, having two ends 18 and 18*a* with threaded sections 19 and 19*a* at each end of the hollow portion has one end 18*a* threadedly engaged with the threaded end 24 of the rod 22 and has a plurality of ports 20 (i.e., holes) therein originating at the hollow portion 17 of the tip which terminate at the tip's surface to allow passage of a liquid from the hollow portion to the outside of the tip.

Ideally, the ports 20 connecting the hollow portion 17 of the cleaning tip with the outside surface of the tip, exit through the tip wall at the end surface 18 of the tip opposite the end of the tip 18*a* that is threadedly connected to the hollow rod.

Preferably, in this embodiment, and shown in FIG. 5 in end view, the threaded hollow end 18 of the cleaning tip opposite the hollow end 18*a* that may be threadedly connected to the hollow rod has a plurality of slots 26 in the threaded portion 19 thereof to allow passage of a liquid through the slots and out of the end of the tip.

In any embodiment of the invention, the means for injecting the liquid component through the device can be a simple suction/pressure bulb, for example, a heavy duty rubber bulb having a capacity of 150 ml of a size of about 73×98 mm with an opening of about 6.4 mm (Fischer Scientific Co. Series No. 14-071) or other suitable liquid injection device.

Further, a brush, patch holder or the like can be threadedly connected to the threaded end of the cleaning tip that is not attached to the hollow rod to assist in cleaning the barrel of the weapon without interferring with the flow of cleaning liquid from the ports in the tip.

PREFERRED METHOD OF USE

A suction/pressure bulb 27, as shown in FIG. 6, is placed at one end of an appropriately sized hollow rod 21, and a cleaning tip 16 designed according to one aspect of the invention is threadedly attached to the threaded opposite end 24 of the rod 21. The bulb is filled with cleaning liquid by squeezing the bulb and placing the cleaning tip in a cleaning liquid and releasing, thereby filling the bulb.

A cleaning brush 28 is threadedly attached to the cleaning tip 16. The device is then inserted about halfway into the barrel of the weapon to be cleaned and some of the cleaning liquid is "squirted" into the barrel through the cleaning tip by utilization of the openings in the tip. The full length of the barrel is scrubbed with the brush. The loosened, dissolved residue is then essentially completely removed by applying constant pressure to the bulb and slowly pushing the rod all the way into the breech end of the barrel.

The residue/liquid mixture is expelled through the vent-hole, or the nipple hole and/or the drum clean-out hole, depending on the type of black powder firearm being cleaned. A drying cloth path is then passed through the barrel, and oil may be then applied to the cleaned barrel using an oiling patch.

The hollow rod may be made up or connected by integral sections for convenience in storage or transport, and/or the rod/tip unit may be of single construction. The device conveniently may be carried in the same fashion as a standard ram-rod is carried, on the gun itself.

While the invention has been described in detail and with reference to a specific embodiment thereof, it will be apparent to one skilled in the art that various changes and modifications can be made therein without departing from the scope and spirit thereof, and therefore, the invention is not intended to be limited except as indicated in the appended claims.

I claim:

1. A ram-rod/cleaning rod device for the barrel portion of a black powder firearm comprising an essentially straight hollow rod of a length at least about equal to the length of said barrel portion, said device having a threaded section at one end thereof of a length sufficient to secure an accessory component having a mating threaded section thereof, and means for receiving a liquid component through the hollow portion of said rod at the opposite end thereof, wherein a hollow cleaning tip having two ends with threaded sections at each end of the hollow portion thereof, having one end threadedly engaged with the threaded end of said device, said cleaning tip having a plurality of openings therein, each opening originating at the hollow portion of said tip and terminating at the surface thereof to allow passage of said liquid component therethrough, wherein the threaded hollow end of the cleaning tip opposite to the hollow end thereof that is threadedly connected to the hollow rod has a plurality of slots in the threaded portion thereof to allow passage of said liquid component therethrough.

2. A ram-rod/cleaning rod device for the barrel portion of a black powder firearm comprising an essentially straight hollow rod of a length at least about equal to the length of said barrel portion having a threaded section at one end thereof of a length sufficient to secure an accessory component thereto having a mating threaded section thereof, and means for receiving a liquid component through the hollow portion of said rod at the opposite end thereof, wherein a plurality of openings are provided about the wall of said rod at a distance from the end of said threaded section sufficient to provide means for allowing at least a portion of said liquid component to exit therefrom, and wherein a hollow cleaning tip having two ends with threaded sections at each end of the hollow portion thereof having one end threadedly engaged with the threaded portion of said device, said cleaning tip having a plurality of openings therein, each opening originating at the hollow portion of said tip and terminating at the surface thereof to allow passage of any remainder of said liquid component therethrough.

* * * * *